US005139920A

United States Patent [19]

Hayashi et al.

[11] Patent Number: 5,139,920

[45] Date of Patent: Aug. 18, 1992

[54] REDUCER AND METHOD FOR CONDUCTING DOT ETCHING PROCESSING OF SILVER IMAGE

[75] Inventors: Katsumi Hayashi; Morio Yagihara; Shinji Ueda; Yoshihiro Fujita; Toshihiko Maekawa; Kiyoshi Morimoto, all of Kanagawa, Japan

[73] Assignee: Fuji Photo Film Co., Ltd., Kanagawa, Japan

[21] Appl. No.: 724,448

[22] Filed: Jul. 3, 1991

Related U.S. Application Data

[63] Continuation of Ser. No. 348,542, May 8, 1989, abandoned.

[30] Foreign Application Priority Data

May 10, 1988 [JP] Japan ..... 63-112716
Jul. 15, 1988 [JP] Japan ..... 63-176326
Sep. 8, 1988 [JP] Japan ..... 63-225282

[51] Int. Cl.[5] ..... G03C 5/42

[52] U.S. Cl. ..... 430/264; 430/430; 430/461; 252/188.2

[58] Field of Search ..... 430/264, 403, 430, 461; 252/188.2

[56] References Cited

U.S. PATENT DOCUMENTS 4,756,918 7/1988 Ueda et al. ..... 430/393

*Primary Examiner*—Charles L. Bowers, Jr.
*Assistant Examiner*—Janet C. Baxter
*Attorney, Agent, or Firm*—Sughrue, Mion, Zinn Macpeak & Seas

[57] ABSTRACT

A reducer and a method for conducting dot etching processing using the reducer, the reducer comprising (1) an amino polycarboxylic acid ferric chelate compound having an oxidation-reduction potential of −100 mV or above, (2) a complexing agent, and (3) at least one member of the compounds represented by the following general formulae (IA) to (VIIA).

(IA)

(IIA)

(IIIA)

(IVA)

(VA)

(VIA)

(VIIA)

All symbols are defined in the specification.

10 Claims, No Drawings

REDUCER AND METHOD FOR CONDUCTING DOT ETCHING PROCESSING OF SILVER IMAGE

This is a continuation of application No. 07/348,542 filed May 8, 1989, now abandoned.

FIELD OF THE INVENTION

This invention relates to a method for conducting dot etching processing for retouching a silver image composed of halftone dots and/or lines obtained by developing and fixing black-and-white photographic materials, particularly plate making photographic materials after exposure. More particularly, it relates to a good reducer which is excellent in shelf stability and does not cause yellow staining photographic materials after processing.

BACKGROUND OF THE INVENTION

There is much literature and many patents relating to the reduction of silver images, particularly halftone or line silver images formed on plate making photographic materials, and various reducers have been conventionally used.

Farmer's reducer mainly (composed of red prussiate) had generally been used in the past. Cerium sulfate reducer and ethylenediaminetetraacetic acid ferric chelate reducer have been used in recent years from the viewpoint of preventing environmental pollution.

As plate making photographic materials, lith films have been mainly used. New high-contrast materials containing hydrazine compounds or tetrazolium compounds have recently been used and the required characteristics of the reducers used have been changed.

Farmer's reducer is neutral and has good reduction characteristics, but has disadvantages in that it causes environmental pollution and it is inferior in shelf stability.

Cerium sulfate reducer has good shelf stability and is a relatively good reducer. However, it has disadvantages in that it is highly acidic, hard to handle and yellow staining is liable to be caused in non-image areas.

Ethylenediaminetetraacetic acid ferric chelate reducer is neutral and inexpensive, but is poor in reduction ability. When novel high-contrast photographic materials having a high silver iodide content are used, a yellowish brown residue is formed around silver images and, hence, the effective reduction degree is decreased. Further, there is the problem that the image area after reduction has a yellow stain.

The term "good reducer" means a reducer where the decrease in area of the silver images relative to the loss in density of the silver images is large, i.e., a reducer where the decrease in size is large.

JP-A-49-33701 ("JP-A" as used herein means an "unexamined published Japanese patent application") discloses reducers where amino polycarboxylic acid ferric chelates are used as oxidizing agents. The earlier discussed problems cannot be solved by the amino polycarboxylic acids described therein when they are used alone. Since the amino polycarboxylic acid ferric chelates are generally low in oxidizing power, the reduction (oxidizing) rate is slow as compared with cerium sulfate and red prussiate. Hence, it is difficult to make a reducer which can be practically used. Further, there are the problems: (1) in particular, when used in combination with novel high-contrast photographic materials, the lowering in the density of halftone dots is high, even when reduction is conducted over a long period of time, (2) the image area after reduction has yellow stain; and (3) a yellowish-brown residue is liable to be left around halftone dots.

JP-A-52-68419 discloses that heterocyclic mercapto compounds used alone and in combination with ethylenediaminetetraacetic acid ferric chelate can be used as reducers. However, the earlier described problems are not solved by such materials.

SUMMARY OF THE INVENTION

An object of the present invention is to provide a reducer which is free from the above problems, and a dot etching method using the same.

Another object of the present invention is to provide a reducer and a dot etching method which are suitable for use in processing the earlier described novel high-contrast photographic materials.

Other objects and effects of the present invention will be apparent from the following description.

We have made studies on many oxidizing agents and accelerators and found that the above-described objects can be achieved by providing a reducer comprising (1) an amino polycarboxylic acid ferric chelate compound having an oxidation-reduction potential of −100 mV or above, (2) a complexing agent, and (3) at least one compound represented by formulae (IA) to (VIIA) described hereinafter.

DETAILED DESCRIPTION OF THE INVENTION

The oxidation-reduction potential of chelate compounds can be measured by conventional methods, for example, the method described in Denkikagaku Sokutei-ho (Jo) (Electrochemical Measuring Method (the first volume)), page 150, by Fujishima et al., published by Gihodo Shuppan (Japan) (1984).

It is preferred that the oxidation-reduction potential of the amino polycarboxylic acid ferric chelate compound is from −100 to +50 mV.

The units used for the oxidation-reduction potential in the present invention are mV v. SCE at a pH of 6.

For example, the redox potential of ethylenediaminetetraacetic acid ferric chelate is −175 mV which is outside the scope of the chelate compounds of the present invention. Examples of chelate compounds having an oxidation-reduction potential within the scope of the invention include ferric chelate compounds of iminodiacetic acid (−63 mV. IDA), glycol ether tetraacetic acid (−25 mV. GEDTA) and 1,3-propanediaminetetraacetic acid (−24 mV. 1,3-PDTA).

Examples of compounds having an oxidation-reduction potential outside the scope of the invention include ferric chelate compounds of ethylenediaminetetraacetic acid (−175 mV. EDTA), 1,2-diaminopropanetetraacetic acid (−157 mV. Me-EDTA) and 1,2-cyclohexanediaminetetraacetic acid (−191 mV. Cy-DTA). These ferric chelate compounds are ineffective as shown in the Examples herein.

The chelate compounds of the present invention may be ammonium salts and alkali metal salts.

The amount of the chelate compound to be used in the present invention varies depending on the reduction degree, the type of photographic materials processed, the density of the silver image, etc., but is generally from 0.3 g/λ to the upper solubility limit, preferably from 5 to 70 g/λ.

As the reduction accelerator used in combination with the chelate compound, there is used at least one compound represented by formulae (IA) to (VIIA).

$$R^{1A}—S\ M^{1A} \quad \text{(IA)}$$

In formula (IA), $M^{1A}$ represents a hydrogen atom, an alkali metal atom or an ammonium group; and $R^{1A}$ represents an alkyl group, an alkylene group, an aryl group or a residue of a heterocyclic ring. Alkyl groups having from 1 to 5 carbon atoms, particularly 1 to 3 carbon atoms are preferred. Alkylene groups having from 2 to 5 carbon atoms are preferred. Examples of the aryl group include phenyl and naphthyl. A phenyl group is preferred. Preferred examples of the heterocyclic ring include nitrogen-containing six-membered rings such as pyridine and triazine and nitrogen-containing five-membered rings such as azole, pyrazole, triazole and thiazole. Among them, those where ring-forming atomic groups have two or more nitrogen atoms, are particularly preferred. $R^{1A}$ may optionally have one or more substituent groups. Examples of the substituent groups include an alkyl group, an alkylene group, an alkoxy group, an alkylthio group, an acyl group, an aryl group, a carboxy group, a sulfo group, an amino group, an alkylamino group, a dialkylamino group, a hydroxy group, a carbamoyl group, a sulfamoyl group and a sulfonamide group.

Among the compounds represented by formula (IA), compounds represented by formula (IA-1) to (IA-4) are preferred.

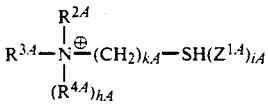

(IA-1)

In formula (IA-1), $R^{2A}$, $R^{3A}$ and $R^{4A}$ are the same or a different group and each is a hydrogen atom, a substituted or unsubstituted lower alkyl group (preferably having from 1 to 5 carbon atoms, more preferably methyl, ethyl and propyl) or an acyl group (preferably having from 1 to 3 carbon atoms, e.g., acetyl, propionyl); kA represents an integer of from 1 to 3; $Z^{1A}$ represents an anion (e.g., a chlorine ion, a bromine ion, a nitrate ion, a sulfate ion, p-toluenesulfonate, an oxalate); hA represents 0 or 1; and iA represents 0 or 1.

$R^{2A}$ and $R^{3A}$ may be combined together to form a ring. Preferably, $R^{2A}$, $R^{3A}$ and $R^{4A}$ each is a hydrogen atom or a substituted or unsubstituted lower alkyl group.

Among the substituent groups for $R^{2A}$, $R^{3A}$ and $R^{4A}$, there preferred are a hydroxyl group, a carboxyl group, a sulfo group and an amino group.

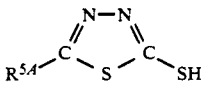

(1A-2)

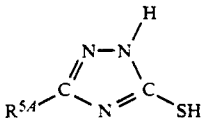

(1A-3)

-continued

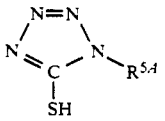

(1A-4)

In formulae (I-2) to (I-4), $R^{5A}$ represents hydrogen atom, a halogen atom (e.g., chlorine, bromine), an amino group, a substituted or unsubstituted lower alkyl group (preferably having from 1 to 5 atoms, particularly preferably methyl, ethyl and propyl), an alkyl group-substituted amino group (e.g., methylamino, ethylamino, dimethylamino, diethylamino) or a substituted or unsubstituted alkylthio group.

As indicated, $R^{5A}$ may optionally be substituted. Examples of substituent groups include a hydroxyl group, a carboxyl group, a sulfo group, an amino group or an alkyl group-substituted amino group.

$$R^{1A}—S—S—R^{6A} \quad \text{(IIA)}$$

In formula (IIA), $R^{1A}$ is the same as set forth in formula (IA) and $R^{6A}$ has the same meaning as $R^{1A}$. $R^{1A}$ and $R^{6A}$ may be the same or different.

Among the compounds represented by formula (IIA), compounds represented by formula (IIA-1) are preferred.

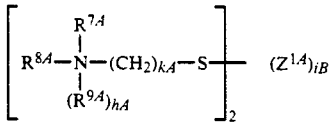

(IIA-1)

In formula (IIA-1), $R^{7A}$, $R^{8A}$ and $R^{9A}$ are the same as in $R^{2A}$, $R^{3A}$ and $R^{4A}$ in formula (IA), respectively; hA, kA and $Z^{1A}$ are the same as in hA, kA and $Z^{1A}$ in formula (IA-1), respectively; and iB is 1 or 2.

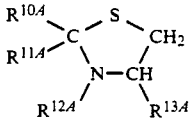

(IIIA)

In formula (IIIA), $R^{10A}$ and $R^{11A}$ are the same or different groups and each is a hydrogen atom, an alkyl group (preferably a lower alkyl group such as methyl, ethyl, propyl), a phenyl group or a residue of a heterocyclic ring. These groups may be optionally substituted.

Examples of the heterocyclic ring include heterocyclic rings containing at least one hetero-atom, e.g., a nitrogen atom, an oxygen atom or a sulfur atom, such as a pyridine ring, a thiophene ring, a thiazolidine ring, a benzoxazole ring, a benztriazole ring a thiazole ring and an imidazole ring.

$R^{12A}$ represents a hydrogen atom or an alkyl group (preferably a lower alkyl group having from 1 to 3 carbon atoms, e.g., methyl, ethyl; the alkyl group may be substituted).

Examples of substituent groups for $R^{10A}$, $R^{11A}$ and $R^{12A}$ include a hydroxyl group, a carboxy group, a sulfo group, an amino group and a lower alkyl group.

$R^{13A}$ represents a hydrogen atom, an alkyl group or a carboxyl group.

$$X^{1A}-(CH_2)_{kB}-S-C(=NR^{14A})(-NR^{15A}R^{16A}) \quad \text{(IVA)}$$

In formula (IVA), $R^{14A}$, $R^{15A}$ and $R^{16A}$ are the same or different and each is a hydrogen atom or an alkyl group (preferably a lower alkyl group having 1 to 3 carbon atoms such as methyl and ethyl; the alkyl group, may be substituted); kB represents an integer of from 1 to 5; and $X^A$ represents an amino group (which may be substituted), a sulfo group, a hydroxyl group, a carboxyl group or a hydrogen atom. Examples of substituent groups include a substituted or unsubstituted alkyl group (e.g., methyl, ethyl, hydroxyalkyl, alkoxyalkyl, carboxyalkyl). Two alkyl groups may combine together to form a ring.

$R^{14A}$, $R^{15A}$ and $R^{16A}$ may combine together to form a ring. Preferably, $R^{14}$, $R^{15}$ and $R^{16}$ each is a hydrogen atom, methyl group or ethyl group. Preferably, $X^{1A}$ is an amino group or a dialkylamino group.

$$A^{1A}-\left[(X^{2A})_{lA}-(R^{19A})_{mA}-\underset{(H)_{pA}}{\overset{R^{17A}}{N}}-R^{18A}\right]_{nA}[Z^{2A}]_{qA} \quad \text{(VA)}$$

In formula (VA), $A^{1A}$ represents an n-valent aliphatic linking group, aromatic linking group or heterocyclic linking group (when nA is 1, $A^{1A}$ is simply an aliphatic group, an aromatic group or a heterocyclic group).

The aliphatic linking group represented by $A^{1A}$ includes an alkylene group having from 3 to 12 carbon atoms (e.g., trimethylene, hexamethylene, cyclohexylene).

The aromatic linking group represented by $A^{1A}$ includes an arylene group having from 6 to 18 carbon atoms (e.g., phenylene, naphthylene).

The heterocyclic linking group includes a heterocyclic ring having at least one hetero-atom (e.g., oxygen atom, sulfur atom or nitrogen atom) such as thiophene, furantriazine, pyridine or piperidine.

Usually, $A^{1A}$ is one member chosen from among aliphatic bond groups, aromatic bond groups and heterocyclic bond groups. If desired, two or more members may be linked to each other directly or through a divalent bond group (e.g., $$-O-,\ -S-,\ \underset{-N-}{\overset{R^{20A}}{|}}-SO_2-,\ -CO-$$

or a bond group formed from these bond groups; $R^{20A}$ is a lower alkyl group).

The aliphatic linking group, the aromatic linking group and the heterocyclic linking group may have one or more substituent groups. Examples of the substituent groups include an alkoxy group, a halogen atom, an alkyl group, a hydroxyl group, a carboxyl group, a sulfo group, a sulfonamide group and a sulfamoyl group.

$X^{2A}$ represents $$-O-,\ -S-\ \text{or}\ \underset{-N-}{\overset{R^{21A}}{|}}$$

(wherein $R^{21A}$ represents hydrogen atom or a lower alkyl group (e.g., methyl, ethyl)). $R^{17A}$ and $R^{18A}$ each represents an alkyl group, preferably a substituted or unsubstituted lower alkyl group (e.g., methyl, ethyl, propyl, isopropyl, pentyl). Examples of substituent groups include hydroxyl group, a lower alkoxy group (e.g., methoxy, methoxyethoxy, hydroxyethoxy) or an amino group (e.g., an unsubstituted amino group, a dimethylamino group, an N-hydroxyethyl-N-methylamino group). When two or more substituent groups are attached, they may be the same or different.

$R^{19A}$ represents an alkylene group, preferably a lower alkylene group having from 1 to 5 carbon atoms (e.g., methylene, ethylene, trimethylene, methylmethylene), and $Z^{2A}$ represents an anion such as a halide ion (chloride, bromide), a nitrate ion, a sulfate ion, a p-toluenesulfonate ion and an oxalate ion.

$R^{17A}$ and $R^{18A}$ may be linked to each other through a carbon atom or a heteroatom (e.g., oxygen, nitrogen, sulfur) to form a five-membered or six-membered heterocyclic ring (e.g., a pyrrolidine ring, a piperidine ring, a morpholine ring, a triazine ring, an imidazolidine ring).

$R^{17A}$ (or $R^{18A}$) and $A^{1A}$ may be linked to each other through a carbon atom or a heteroatom (e.g., oxygen, nitrogen, sulfur) to form a five-membered or six-membered heterocyclic ring (e.g., a hydroxyquinoline ring,a hydroxyindole ring, an isoindolin ring).

$R^{17A}$ (or $R^{18A}$) and $R^{19A}$ may be linked to each other through carbon atom or a heteroatom (e.g., oxygen, nitrogen, sulfur) to form a five-membered or six-membered heterocyclic ring (e.g., a piperidine ring, a pyrrolidine ring, a morpholine ring).

lA is 0 or 1; mA is 0 or 1; nA is 1, 2 or 3; pA is 0 or 1; and qA is 0, 1, 2 or 3.

$$X^{1A}-(CH_2)_{KB}-\overset{R^{22A}}{\overset{|}{N}}-\underset{S}{\overset{\|}{C}}-S-M^{2A} \quad \text{(VIA)}$$

In formula (VIA), $X^{1A}$ and kB are the same as in formula (IVA); $M^{2A}$ represents a hydrogen atom, an alkali metal, an ammonium group or $$-S-\underset{S}{\overset{\|}{C}}-\underset{R^{22A}}{\overset{|}{N}}-(CH_2)_{kB}-X^{1A};$$

and $R^{22A}$ represents a hydrogen atom or a substituted or unsubstituted alkyl group (preferably, a lower alkyl group having from 1 to 5 carbon atoms, and kB and $X^{1A}$ are the same as in formula (IVA).

$$A^1(B^1)_nA^2(Z^1) \quad \text{(VIIA)}$$

In formula (VIIA), $A^1$ and $A^2$ are the same or different and each is $$R^2-\underset{(R^3)_q}{\overset{R^1}{N}}-$$

or a residue of a saturated or unsaturated heterocyclic ring containing at least one nitrogen atom. $R^1$, $R^2$ and $R^3$ are the same or different and each is a hydrogen atom or a substituted or unsubstituted alkyl group. Examples of substituent groups include a hydroxyl group, a sulfo group, an alkoxy group, an aryl group, an amino group, an alkyl-substituted amino group, an alkyl group or a halogen atom. Alkyl groups having from 1 to 4 carbon atoms are preferred. q is 0 or 1. Any nitrogen atom in the residue of the heterocyclic ring may be quaternized. The heterocyclic ring may contain an oxygen atom and/or a sulfur atom. Five-membered and six-membered heterocyclic rings are preferred. Examples of the residues of the rings include an imidazolyl group, a thiazolyl group, a thazolinyl group, an oxazolyl group, a triazolyl group, a pyridyl group, a pyrimidinyl group, a pyrrolidinyl group, pyrrolinyl group, an imidazolidinyl group, an imidazolinyl group, a piperidyl group, a piperadinyl group and a morpholinyl group. The pKa values of the conjugate acids of these heterocyclic rings are preferably from 4 to 10. Among them, a pyridyl group and an imidazolinyl group are particularly preferred. These heterocyclic rings may have one or more substituent groups. Examples of the substituent groups are those described above in the definitions of $R^1$, $R^2$ and $R^3$.

$B^1$ represents a divalent organic group consisting of an alkylene group, an alkenylene group, an arylene group, $$-SO_2-,\ -SO-,\ -S-,\ -\overset{\overset{\displaystyle O}{\|}}{C}-,\ -O-,\ -\underset{\underset{\displaystyle R^4}{|}}{C}-\ \text{or}\ -N-$$

(where $R^4$ is a hydrogen atom, an alkyl group or an aryl group) alone or a combination thereof. Preferably, $B^1$ is a divalent organic group consisting of an alkylene group, —S— or —O— alone or a combination thereof. Groups composed of two or more —S— are particularly preferred.

h is 0 or 1; $Z^1$ is an anion (e.g., a chlorine ion, a bromine ion, a nitrate ion, a sulfate ion, a p-toluenesulfonate ion, an oxalate ion); and i is 0, 1 or 2.

Concrete examples of the compounds represented by the formulae (IA) to (VIIA) include the following compounds.

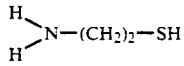
(IA)-(1)

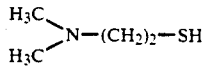
(IA)-(2)

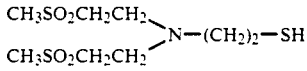
(IA)-(3)

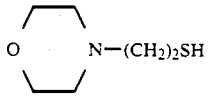
(IA)-(4)

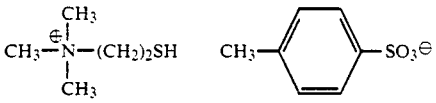
(IA)-(5)

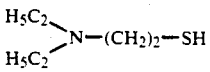
(IA)-(6)

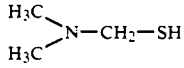
(IA)-(7)

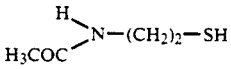
(IA)-(8)

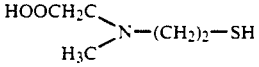
(IA)-(9)

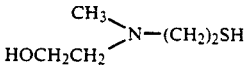
(IA)-(10)

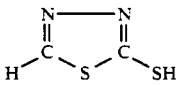
(IA)-(11)

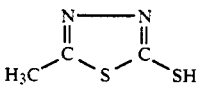
(IA)-(12)

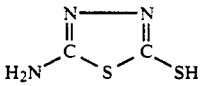
(IA)-(13)

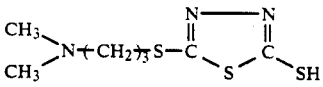
(IA)-(14)

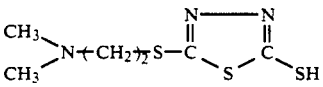
(IA)-(15)

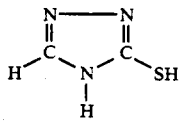
(IA)-(16)

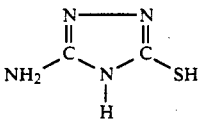
(IA)-(17)

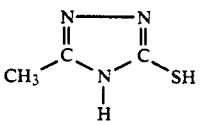
(IA)-(18)

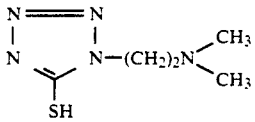
(IA)-(19)

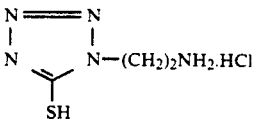
(IA)-(20)

-continued $HOCH_2CH_2SH$ (IA)-(21)

$HOOCCH_2SCH_2CH_2SH$ (IA)-(22)

$HOCH_2CH(OH)CH_2SH$ (IA)-(23)

$HOCH_2C(=O)CH_2CH_2SH$ (IA)-(24)

$HO_3SCH_2CH_2CH_2SH$ (IA)-(25)

$HOCH_2CH_2CH_2SH$ (IA)-(26)

(IIA)-(1)

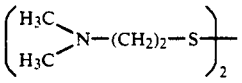

(IIA)-(2)

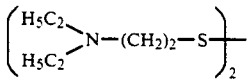

(IIA)-(3)

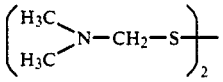

(IIA)-(4)

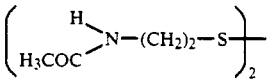

(IIA)-(5)

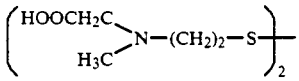

(IIA)-(6)

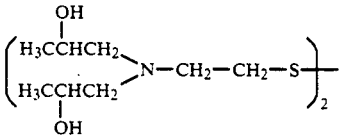

(IIA)-(7)

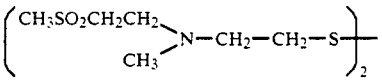

(IIA)-(8)

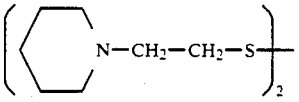

(IIA)-(9)

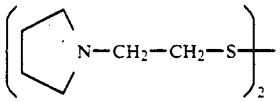

(IIA)-(10)

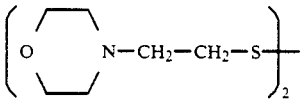

(IIA)-(11)

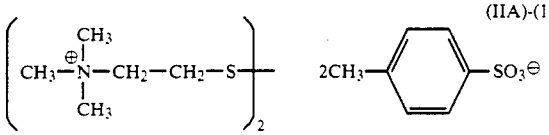

(IIA)-(12)

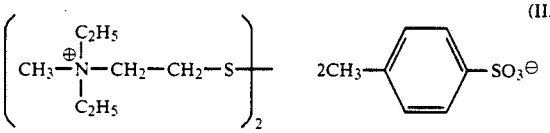

$(HOCH_2CH_2S\rightarrow)_2$ (IIA)-(13)

$(HO_2CCH_2SCH_2CH_2S\rightarrow)_2$ (IIA)-(14)

$(HOCH_2CH(OH)CH_2S\rightarrow)_2$ (IIA)-(15)

$(HOCH_2C(=O)CH_2CH_2S\rightarrow)_2$ (IIA)-(16)

$(HO_3SCH_2CH_2CH_2S\rightarrow)_2$ (IIA)-(17)

$(HOCH_2CH_2CH_2S\rightarrow)_2$ (IIA)-(18)

(IIIA)-(1)

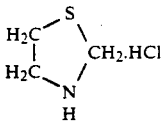

(IIIA)-(2)

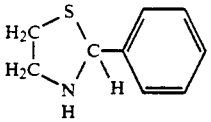

(IIIA)-(3)

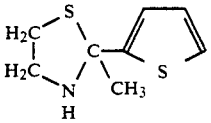

(IIIA)-(4)

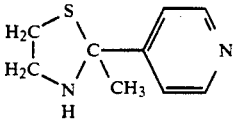

(IIIA)-(5)

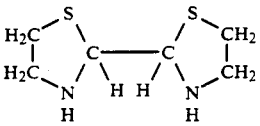

(IIIA)-(6)

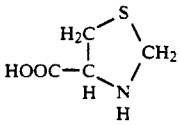

(IVA)-(1)

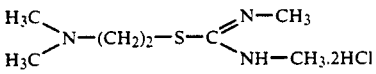

(IVA)-(2)

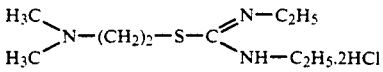

-continued
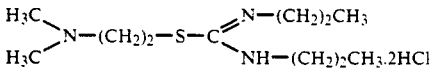
(IVA)-(3)
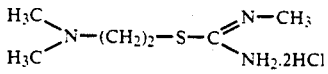
(IVA)-(4)
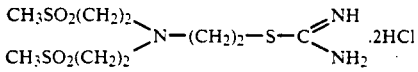
(IVA)-(5)
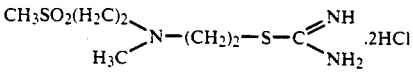
(IVA)-(6)
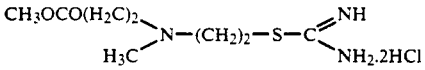
(IVA)-(7)
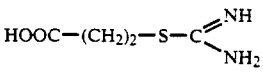
(IVA)-(8)
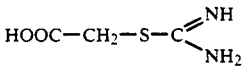
(IVA)-(9)
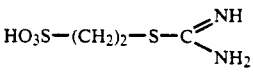
(IVA)-(10)
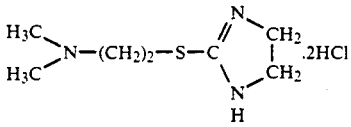
(IVA)-(11)
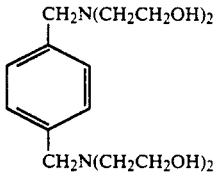
(VA)-(1)
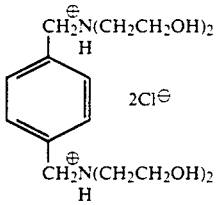
(VA)-(2)
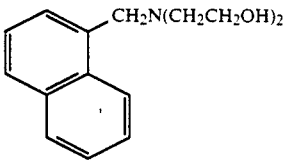
(VA)-(3)
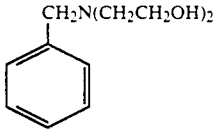
(VA)-(4)
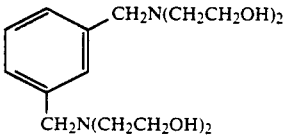
(VA)-(5)
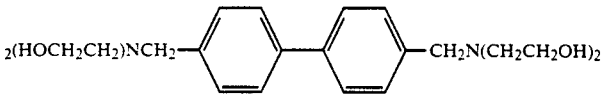
(VA)-(6)
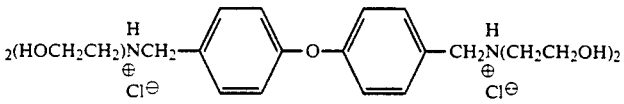
(VA)-(7)
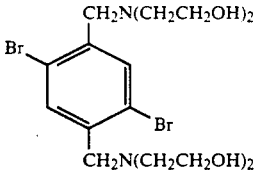
(VA)-(8)
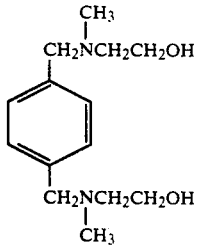
(VA)-(9)
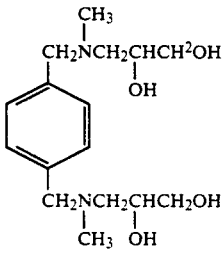
(VA)-(10)

-continued
(VA)-(11)
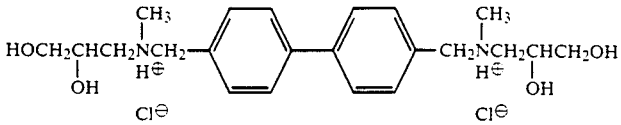
(VA)-(12)
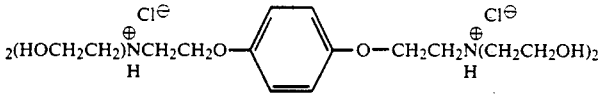
(VA)-(13)
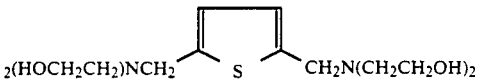
(VA)-(14)
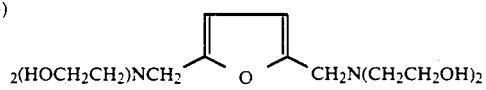
(VA)-(15)
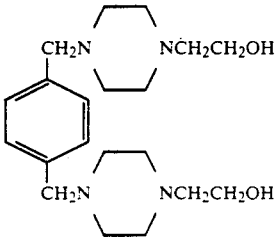
(VA)-(16)
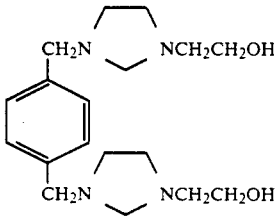
(VA)-(17)
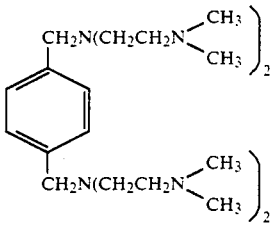
(VA)-(18)
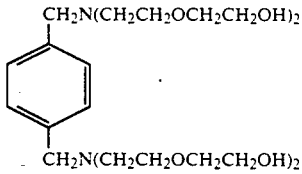
(VA)-(19)
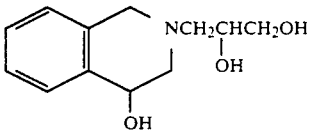
(VA)-(20)
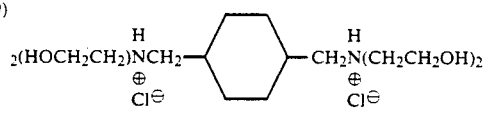
(VA)-(21)
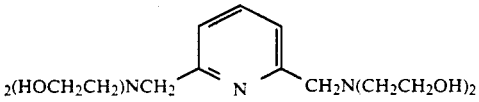
(VA)-(22)
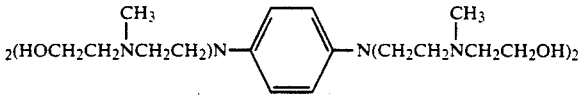
(VA)-(23)
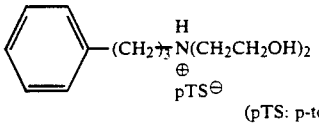
(pTS: p-toluenesulfonic acid)
(VA)-(24)
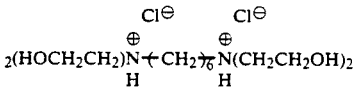
(VA)-(25)
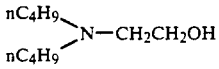
(VA)-(26)
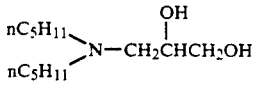
(VIA)-(1)
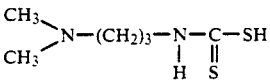
(VIA)-(2)
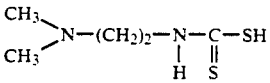

-continued
(VIA)-(3)
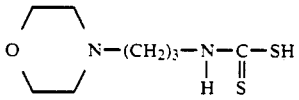
(VIA)-(4)
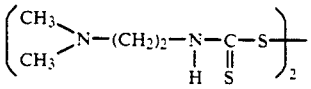
(VIA)-(5)
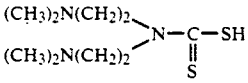
(VII)-(1)
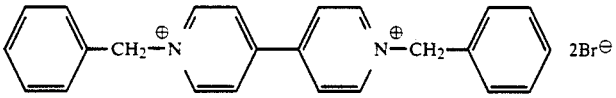
(VII)-(2)
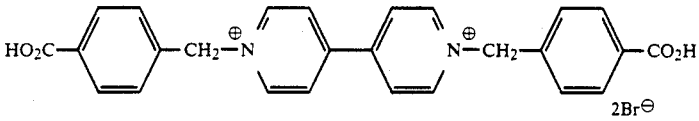
(VII)-(3)
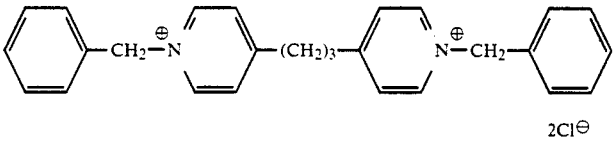
(VII)-(4)
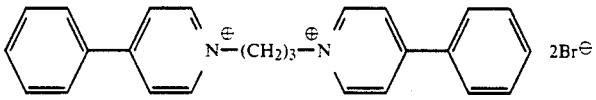
(VII)-(5)
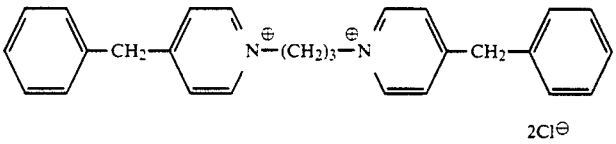
(VII)-(6)
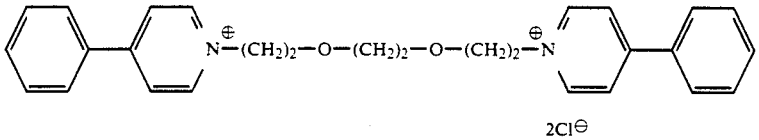
(VII)-(7)
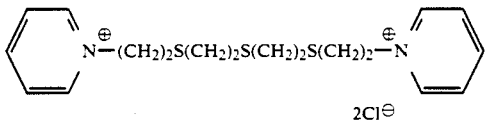
(VII)-(8)
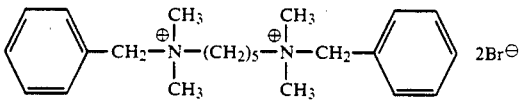
(VII)-(9)
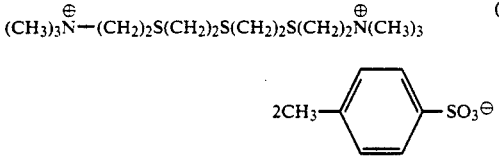
(VII)-(10)
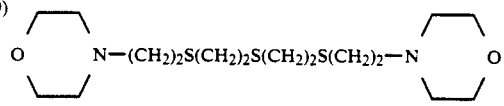
(VII)-(11)
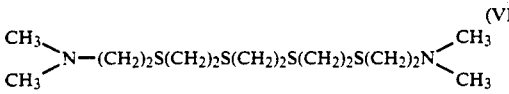
(VII)-(12)
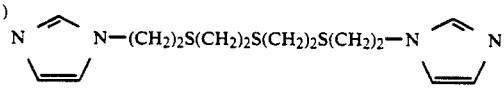
(VII)-(13)
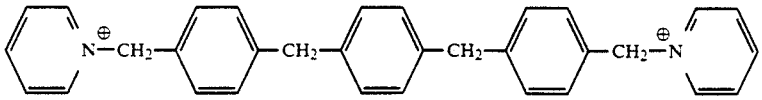

-continued

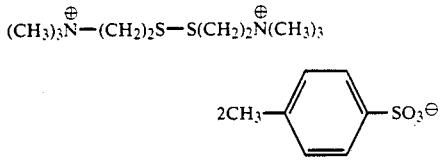

(VII)-(14)

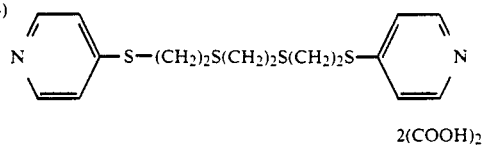

(VII)-(15)

Among the above-described reduction accelerators, particularly preferred are compounds IA-2, IA-5, IA-13, IA-14, IA-15, IA-16, IA-19, IIA-1, IIA-11, VA-1, VIA-1, VIA-2, VII-1, VII-2, VII-3, VII-9, VII-10 and VII-11.

The amounts of the compounds of formulae (IA) to (VIIA) vary depending on the desired reduction degree and the types of photographic materials, but are generally 0.001 to 3.0 g/l, preferably 0.01 to 0.05 g/l. These compounds may be used either alone or as a combination of two or more thereof.

The pH of the reducer of the present invention is preferably in the range of 2 to 8.

The reducer of the present invention is basically an aqueous solution of the above-described (1) amino polycarboxylic acid ferric chelate, (2) a complexing agent and (3) the sulfur-containing compound, i.e., the compounds of formulae (IA) to (VIIA).

If desired, other additives such as pH buffering agent, preservative (e.g., sulfite), halide, etc. may be added.

As the complexing agent used in the reducer, conventional solvents for silver halide can be used. Examples of the complexing agent include sodium thiosulfate, ammonium thiosulfate, ammonium thiocyanate, thiourea, halides and thioethers. The amount of the complexing agent is preferably from 5 to 200 g/l, and more perferably from 10 to 100 g/l.

The reducer of the present invention may also contain a surfactant, a thickener and/or a dye.

In the present invention, dot etching processing of a silver image is carried out by immersing a photographic material having a silver image formed thereon in the reducer, the silver image having been formed by conventional processes, i.e., at least development and fixing, usually with a further water washing and drying. In the present invention, it is also possible that the dot etching be conducted by bringing the silver image into contact with a sheet formed by impregnating a support with a hydrophilic binder such as gelatin, polyvinyl alcohol or polyacrylic acid and coating the support with the reducer of the present invention.

The effect of the present invention can be enhanced by carrying out a pretreatment with a solution containing sodium sulfate, ammonium thiosulfate, sodium sulfite and/or sodium thiosulfate prior to the dot etching processing.

There are no particular limitations with respect to the halogen compositions of the black-and-white silver halide photographic materials to which the dot etching processing of the present invention is applied. Any of silver chlorobromide, silver chloride, silver iodobromide, silver iodobromochloride and combinations of two or more thereof can be used. A remarkable effect can be obtained, when the halogen compositions contain silver iodide with the preferred iodide content being 1 mol% or less.

The silver halide photographic emulsions of the present invention can be prepared by conventional methods such as the methods described in Research Disclosure (RD), No. 17643 (Dec. 1978), pages 22 to 23, item "I. Emulsion preparation and types" and ibid., No. 18716 (Nov. 1979) page 648. There can also be used tabular grains as described in U.S. Pat. Nos. 4,434,226 and 4,439,520 and Research Disclosure No. 22534 (Jan. 1983).

Various additives which can be used in the present invention are described in the aforementioned Research Disclosure, No. 17643, pages 23 to 28 and ibid., No. 18716, pages 648 to 651. The types of these additives and the location of the descriptions are given in the following Table.

| Type of additive | RD17643 | RD18716 |
|---|---|---|
| Chemical sensitizer | page 23 | right column of page 648 |
| Sensitivity improver | | right column of page 648 |
| Spectral sensitizer | pages 23–24 | right column of page 648 |
| Supersensitizer | | right column of page 649 |
| Brightener | page 24 | |
| Antifogging agent and stabilizer | pages 24–25 | right column of page 649 |
| Light absorber, filter dye | pages 25–26 | right column of page 649 to left column of page 650 |
| UV absorber | | |
| Stain inhibitor | right column of page 25 | left and right column of page 650 |
| Hardening agent | page 26 | left column of page 651 |
| Binder | page 26 | left column of page 651 |
| Plasticizer, lubricant | page 27 | right column of page 650 |
| Coating aid | page 26–27 | right column of page 650 |
| Surfactant | | |
| Antistatic agent | page 27 | right column of page 650 |

It is preferred that the dot etching processing of the present invention be applied to plate making photographic materials, though there is no particular limitation with respect to the silver halide photographic materials to which the present invention is applied. The dot etching processing of the present invention can be applied to photographic materials which have been processed with lith developing solutions. Lith developing solutions basically comprise dihydroxybenzene, alkali agents, small amounts of sulfites and a sulfurous acid buffer.

The dot etching processing method of the present invention can be effectively applied in particular to super-high-contrast photographic materials containing hydrazine derivatives. These photographic materials are described in more detail in JP-A-53-16623, JP-A-53-20922, JP-A-53-66732, U.S. Pat. Nos. 4,224,401, 4,168.977, 4,166,742, 4,311,781, 4,272,606, 4,211,857 and 4,243,739.

The compounds described in JP-A-63-124045 and JP-A-63-133145 may be used as nucleating accelerators.

The present invention can also be effectively applied to high-contrast photographic materials containing tetrazolium salts described in JP-A-52-18317, JP-A-53-95628 and JP-A-53-95629.

These high-contrast photographic materials have an advantage in that photographic characteristics such as high contrast can be obtained by using a developing solution more stable than lith developing solutions.

The developing solutions used therefor contain a hydroxybenzene developing agent as a main developing agent and a p-aminophenol or 1-phenyl-3-pyrazolidone developer as a developing aid. The developer may be incorporated in the photographic materials. Examples of preservatives used include sodium sulfite, potassium sulfite, sodium bisulfite and formaldehyde-sodium bisulfite.

The pH of the developing solution is generally adjusted to from 10.1 to 12.3. Conventional water-soluble inorganic alkali metal salts such as sodium hydroxide, potassium carbonate and potassium tertiary phosphate can be used as alkali agents to adjust the pH. Alkanolamines described in U.S. Pat. No. 4,269,929 can also be used.

Generally, the developing solutions may contain pH buffering agents such as boric acid, restrainers such as potassium bromide and potassium iodide, organic solvents such as triethylene glycol and ethanol and antifogging agents or black dot inhibitors such as benzotriazole compound (e.g., 5-methylbenztriazole) and indazole compounds (e.g., 5-nitroindazole). Further, the developing solutions may optionally contain color toning agents, surfactants, water softeners, etc.

Fixing solutions having a conventional composition can be used. Thiosulfates and thiocyanates are generally used as fixing agents. In addition, there can be used organosulfur compounds which have been conventionally used as fixing agents. The fixing solutions may contain water-soluble aluminum salts such as aluminum sulfate and alum as hardening agents. The water-soluble aluminum salt is used in an amount of 0 to 3.0 g as aluminum per litter. Ethylenediaminetetraacetic acid Fe (III) complex salt may be used as an oxidizing agent.

The processing temperature is usually in the range of 18 to 50° C. However, processing can be carried out at a temperature lower than 18° C. and higher than 50° C.

The present invention is now illustrated in greater detail by reference to the following examples, but the present invention is not construed as being limited thereto.

EXAMPLE 1

An aqueous solution of silver nitrate and an aqueous solution of potassium iodide and potassium bromide were simultaneously added to an aqueous gelatin solution kept at 50° C. in the presence of $4\times10^{-7}$ mol (per mol of silver) of iridium potassium hexachloride and ammonium over a period of 60 minutes while keeping the pAg at 7.8, thus preparing a cubic monodisperse silver iodobromide emulsion having a mean grain size of 0.28 λ and an average silver iodide content of 0.3 mol%. After the emulsion was desalted by a conventional flocculation method, 40 g (per mol of silver) of inactive gelatin was added thereto while keeping the temperature of the mixture at 50° C. and 5,5'-dichloro-9-ethyl 3,3'-bis-(3-sulfopropyl) oxacarbocyanine as a sensitizing dye and $10^{-3}$ mol (per mol of silver) of a KI solution were added thereto. After 15 minutes, the temperature of the emulsion was allowed to drop. The emulsion was re-dissolved. 0.02 mol (per mol of silver) of methylhydroquinone, the following sensitizing dye (1) and $1.2\times10^{-3}$ mol (per mol of Ag) of the following hydrazine derivative (2) were added thereto at 40° C. Further, the following additive (3), 5-methylbenztriazole, 4-hydroxy-6-methyl-1,3,3a-7-tetrazaindene, the following accelerators (4, 5), a dispersion of polyethyl acrylate and a hardening agent were added thereto. A polyethylene terephthalate film was coated with the resulting solution.

1.

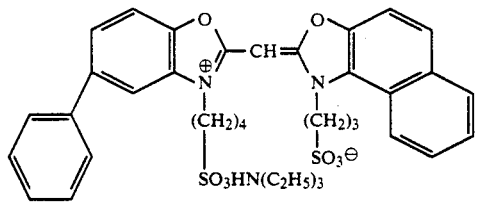

2.

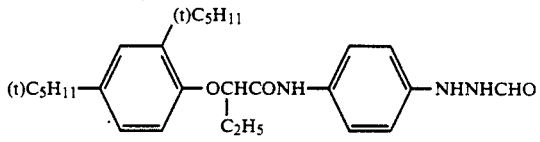

3.

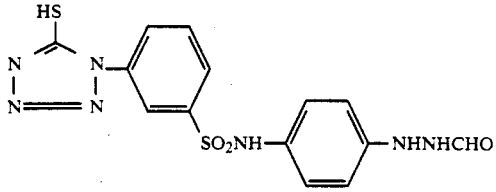

-continued

4.

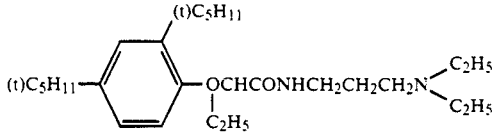

5.

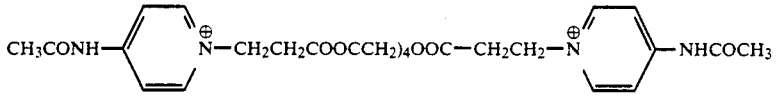

The thus-obtained film was exposed through a wedge for sensitometry using a 150 line contact screen, developed at 34° C. for 30 seconds using developing solution having the following composition, fixed, washed with water and dried.

| Developing solution | |
|---|---|
| Tetrasodium ethylenediaminetetraacetate | 1 g |
| Sodium hydroxide | 18 g |
| Potassium hydroxide | 55 g |
| 5-Sulfosalicylic acid | 45 g |
| Boric acid | 25 g |
| Potassium sulfite | 110 g |
| n-Butyldiethanolamine | 15 g |
| N-methyl-p-aminophenol ½ sulfate | 0.8 g |
| Hydroquinone | 35 g |
| 5-Methylbenztriazole | 0.5 g |
| Sodium bromide | 3 g |
| Water to make | 1 liter |

The fixing solution used was GR-F-1 (a product of Fuji Photo Film Co., Ltd.).

The resulting halftone silver image (area ratio: 50%) was subjected to reduction processing with the following reducer.

The reduction rate was determined by the area ratio of halftone dots after processing for 60 seconds; the reducibility was determined by the density after 10% reduction (the density of the silver image before reduction being 4.60 or above); and the residue around the halftone dots was examined. The results are shown in Table 1.

| Reducer | 1 | 2 | 3 | 4 | 5 |
|---|---|---|---|---|---|
| EDTA-Fe. $NH_4$ | 30 | | 30 | | |
| | | 28 | 0 | 28 | 28 |
| Compound (IA)-(13) | | | 0.15 | 0.15 | |
| (IIA)-(2) | | | | | 0.6 |
| Ammonium thiosulfate | 18 | 18 | 18 | 18 | 18 |

Unit: g/l, pH adjusted to 4.

TABLE 1

| Reducer | Reduction rate (%) | Reducibility | Residue around halftone dots |
|---|---|---|---|
| 1. (Comp. Ex.) | 49 | 1.8 | found |
| 2. (Comp. Ex.) | 45 | 3.2 | none |
| 3. (Comp. Ex.) | 48 | 2.0 | found |
| 4. (Invention) | 38 | 4.1 | none |
| 5. (Invention) | 41 | 3.5 | none |

It is apparent form Table 1 that only when the chelate compounds having an oxidation-reduction potential within the scope of the invention are used in combination with the reduction accelerators of the invention that the reduction rate is high, the reduction degree is greatly widened and no residue is found.

EXAMPLE 2

A silver bromochloroiodide emulsion composed of 80 mol% of silver chloride, 19.5 mol% of silver bromide and 0.5 mol% of silver iodide was subjected to conventional gold sensitization and sulfur sensitization. Further, spectral sensitizing agent (1), development accelerator (2), hardening agent (3]and latex in order were added thereto. A polyethylene terephthalate film was coated with the resulting emulsion.

1. 3-Carboxymethyl-5-(2-(3-ethylthiazolinidene) ethylidene) rhodanine
2. Polyoxyethylene nonylphenyl ether (50 ethylene oxide groups)
3. Mucochloric acid The resulting photographic material was exposed through a magenta contact screen, developed at 32° C. for one minute using HS-5 (a product of Fuji Photo Film Co., Ltd.) and then subjected to reduction processing with the following reducer. The results are shown in Table 2.

| Reducer | 1 | 2 | 3 | 4 | 5 |
|---|---|---|---|---|---|
| EDTA-Fe. $NH_4$ | 45 | 45 | | | |
| GEDTA-Fe. $NH_4$ | | | 32 | 32 | 32 |
| Compound (IA)-(13) | | 1.2 | | 1.2 | |
| (IIA)-(2) | | | | | 2.1 |
| Ammonium thiosulfate | 60 | 60 | 60 | 60 | 60 |

Unit: g/l. pH adjusted to 5.5.

TABLE 2

| Reducer | Reduction rate (%) | Reducibility |
|---|---|---|
| 1. (Comp. Ex.) | 50 | 1.7 |
| 2. (Comp. Ex.) | 49 | 2.0 |
| 3. (Comp. Ex.) | 44 | 2.7 |
| 4. (Invention) | 40 | 3.7 |
| 5. (Invention) | 42 | 3.9 |

It is apparent from Table 2 that the reducer of the present invention is excellent in reduction rate as well as reduction degree.

EXAMPLE 3

An aqueous solution of silver nitrate and an aqueous solution of sodium chloride were simultaneously added to an aqueous gelatin solution kept at 40° C. in the presence of $5\times10^{-6}$ mol (per mol of silver) of $(NH_4)_3RhCl_6$ to prepare silver chloride grains. After soluble salts were removed by a conventional method, gelatin was added thereto. Without carrying out chemical ripening, 2-methyl-4-hydroxy-1,3,3a, 7-tetraazaindene as a stabilizer was added thereto. The resulting emulsion was a cubic monodisperse emulsion having a mean grain size of 0.2μ.

To the emulsion were added the following hydrazine compound (70 mg/m²) A, nucleating accelerator (45 mg/m²) B and then 30 wt% (on a solid basis; based on the amount of gelatin) of polyethyl acrylate latex. Further, 1,3-divinylsulfonyl-2-propanol as a hardening agent was added thereto. A polyester support was coated with the resulting solution in such an amount as to give a coating weight of 3.8 g/m² in terms of silver. The amount of gelatin in the emulsion layer was 1.8 g/m². A layer of gelatin (1.0 g/m²) as a protective layer was coated on the surface of the emulsion layer.

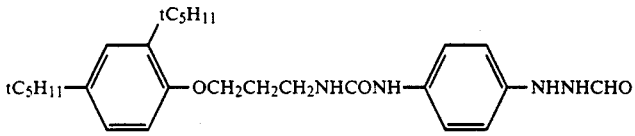

A

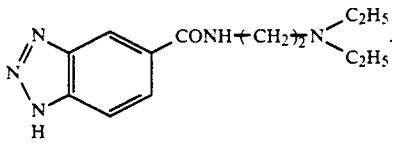

B

The sample was exposed (50% halftone dots) through an optical wedge using a daylight printer p-607 (manufactured by Dainippon Screen Mfg. Co., Ltd.), developed at 38° C. for 30 seconds using GR-D1 (a product of Fuji Photo Film Co., Ltd.), fixed, washed with water and dried. The results on photographic characteristics are shown in Table 3.

| Reducer | 1 | 2 | 3 | 4 | 5 |
|---|---|---|---|---|---|
| Cy-DTA-Fe. $NH_4$ | 40 | | | | |
| 1,3-PDTA-Fe. $NH_4$ | | 35 | 35 | 35 | 35 |
| Compound (IA)-(16) | | | 0.09 | | |
| (IA)-(15) | | | | 0.12 | |
| (IVA)-(5) | | | | | 1.8 |
| Sodium thiosulfate | 40 | 40 | 40 | 40 | 40 |

Unit: g/l. pH adjusted to 5.

TABLE 3

| Reducer | Reduction rate (%) | Reducibility | Residue around halftone dots |
|---|---|---|---|
| 1. (Comp. Ex.) | 49 | 1.5 | found |
| 2. (Comp. Ex.) | 45 | 3.0 | found |
| 3. (Invention) | 38 | 4.1 | none |
| 4. (Invention) | 35 | 4.0 | none |
| 5. (Invention) | 41 | 3.8 | none |

It is apparent from Table 3 that when the chelate compounds having an oxidation-reduction potential within the scope of the invention are used in combination with the reduction accelerator of the invention, no residue is found, a high reduction rate is obtained and a good reduction degree can be obtained.

EXAMPLE 4

The reducer given in the following table was used. All other factors were the same as in Example 1.

| Reducer | 1 | 2 | 3 |
|---|---|---|---|
| 1,3-PDTA-Fe. $NH_4$ | 28 | 28 | 28 |

-continued

| Reducer | 1 | 2 | 3 |
|---|---|---|---|
| Compound VII-1 | | 0.45 | |
| VII-3 | | | 0.5 |
| Sodium thiosulfate | 18 | 18 | 18 |

Unit: g/l. pH adjusted to 4.

TABLE 4

| Reducer | Reduction rate (%) | Reducibility | Residue around halftone dots |
|---|---|---|---|
| 1. (Comp. Ex.) | 45 | 3.2 | none |
| 2. (Invention) | 36 | 4.0 | none |
| 3. (Invention) | 37 | 3.7 | none |

It is apparent from Table 4 that when the reduction accelerator of the invention is used, a high reduction rate can be obtained, the reduction degree is greatly widened and no residue is found.

EXAMPLE 5

The reducer given in the following table was used. All other factors were the same as in Example 2.

| Reducer | 1 | 2 |
|---|---|---|
| 1,3-PDTA-Fe. $NH_4$ | 42 | 42 |
| Compound (VII-11) | | 0.9 |
| Sodium thiosulfate | 60 | 60 |

Unit: g/l. pH was adjusted to 5.0.

TABLE 5

| Reducer | Reduction rate (%) | Reducibility |
|---|---|---|
| 1. (Comp. Ex.) | 47 | 1.9 |
| 2. (Invention) | 40 | 2.9 |

It is apparent from Table 5 that the reducer of the invention is excellent in reduction rate as well as reduction degree.

While the invention has been described in detail and with reference to specific examples thereof, it will be apparent to one skilled in the art that various changes and modifications can be made therein without departing from the spirit and scope thereof.

What is claimed is:

1. A reducer for conducting reduction processing of black-and-white halftone image comprising (1) an amino polycarboxylic acid ferric chelate compound having an oxidation-reduction potential of −100 mV or above, (2) a complexing agent, and (3) at least one member of the compounds represented by formulae (VA) to (VIIA):

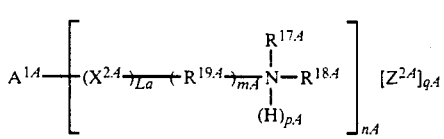

(VA)

wherein $A^{1A}$ is an nA-valent aliphatic bond group, an aromatic bond group or a heterocyclic bond group;

$X^{2A}$ is —O—, —S— or —N— ($R^{21A}$)

wherein $R^{21A}$ is a hydrogen atom or a lower alkyl group, $R^{17A}$ and $R^{18A}$ are each an alkyl group; $R^{19A}$ is an alkyl group; $Z^{2A}$ is an anion; lA is 0 or 1; mA is 0 or 1; nA is 1, 2 or 3; pA is 0 or 1; and qA is 0, 1, 2, or 3; and $R^{17A}$ and $R^{18A}$ may be linked to each other through a carbon atom or a heteroatom to form a ring;

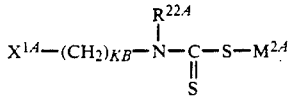

(VIA)

wherein $X^{1A}$ represents an amino group, a sulfo group, a hydroxyl group, a carboxyl group or a hydrogen atom; kB is an integer of from 1 to 5; $M^{2A}$ represents a hydrogen atom, an alkali metal atom, an ammonium group or

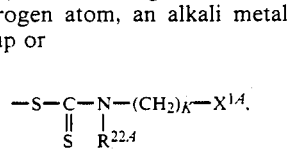

wherein $R^{22A}$ is a hydrogen atom or an alkyl group;

$A^1(B^1)_h A^2(Z^1)_i$ (VIIA)

wherein $A^1$ and $A^2$ are each

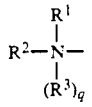

or a residue of a saturated or unsaturated heterocyclic ring containing at least one nitrogen atom, and $A^1$ and $A^2$ may be the same or different; $R^1$, $R^2$ and $R^3$ are the same or different and each is a hydrogen atom or an alkyl group; q is 0 or 1; the nitrogen atom of the heterocyclic ring may be quaternized; the heterocyclic ring may optionally contain an oxygen atom and/or sulfur atom; $B^1$ is a bivalent organic group consisting of an alkylene group, an alkenylene group, an arylene group, $-SO_2-$, —SO—, —S—, —O—, —C(=O)— or —N($R^4$)—, (wherein $R^4$ is a hydrogen atom, an alkyl group or an aryl group), alone or as a combination of two or more of them; h is 0 or 1; $Z^1$ is an anion; and i is 0, 1 or 2.

2. A reducer as claimed in claim 1, wherein the amount of said amino polycarboxylic acid ferric chelate compound is from 0.3 g/l to the solubility upper limit, the amount of said complexing agent is from 5 to 200 g/l, and the amount of said compound of formulae (VA) to (VIIA) is in the range of from 0.001 to 3.0 g/l.

3. A reducer as claimed in claim 1, wherein the amount of said amino polycarboxylic acid ferric chelate compound is from 5 to 70 g/l, the amount of said complexing agent is from 10 to 100 g/l, and the amount of said compound of formulae (VA) to (VIIA) is in the range of from 0.01 to 0.05 g/l.

4. A reducer as claimed in claim 1 which has a pH of from 2 to 8.

5. A reducer as claimed in claim 1, wherein the aminopolycarboxylic acid ferric chelate compound is a ferric chelate compound of iminodiacetic acid or 1,3-propanediaminetetraacetic acid.

6. A reducer for conducting reduction processing of blackand-white halftone images comprising (1) a ferric chelate compound of glycol ether tetraacetic acid, (2) a comlexing agent, and (3) at least one member of the compounds represented by formulae (IA) to (VIIA):

$R^{1A}$—S—$M^{1A}$ (IA)

wherein $M^{1A}$ represents a hydrogen atom, an alkali metal atom or an ammonium group; and $R^{1A}$ represents an alkyl group, an alkylene group, an aryl group or a residue of a heterocyclic ring;

$R^{1A}$—S—S—$R^{6A}$ (IIA)

wherein $R^{1A}$ is the same as in formula (IA); $R^{6A}$ has the same meaning as $R^{1A}$; and $R^{1A}$ and $R^{6A}$ are the same or different;

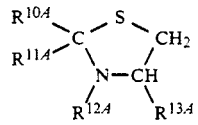

(IIIA)

wherein $R^{10}$ and $R^{11A}$ are the same or different and each is a hydrogen atom, an alkyl group, an aryl group or a residue of a heterocyclic ring; $R^{12A}$ represents a hydrogen atom or an alkyl group; and $R^{13A}$ represents a hydrogen atom, an alkyl group or a carboxyl group;

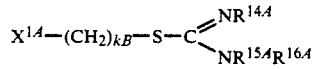

(IVA)

wherein $R^{14A}$, $R^{15A}$ and $R^{16A}$ are the same or different and each is a hydrogen atom or an alkyl group; kB is an integer of from 1 to 5; and $X^{1A}$ represents an amino group, a sulfo group, a hydroxyl group, a carboxyl group or a hydrogen atom;

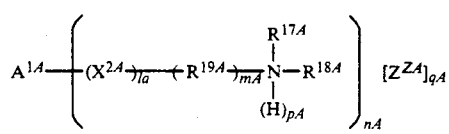

(VA)

wherein $A^{1A}$ is an nA-valent aliphatic bond group, an aromatic bond group or a heterocyclic bond group;

$X^{2A}$ is $-O-$, $-S-$ or $-\underset{\underset{R^{21A}}{|}}{N}-$ wherein $R^{21A}$ is a hydrogen atom or a lower alkyl group, $R^{17A}$ and $R^{18A}$ are each an alkyl group; $R^{19A}$ is an alkyl group; $Z^{2A}$ is an anion; lA is 0 or 1; mA is 0 or 1; nA is 1, 2 or 3; pA is 0 or 1; and qA is 0, 1, 2, or 3; and $R^{17A}$ and $R^{18A}$ may be linked to each other through a carbon atom or a heteroatom to form a ring;

$$X^{1A}-(CH_2)_{Kb}-\overset{\overset{R^{22A}}{|}}{N}-\underset{\underset{S}{\|}}{C}-S-M^{2A} \quad \text{(VIA)}$$

wherein $X^{1A}$ and kB are the same as in formula (IVA); $M^{2A}$ represents a hydrogen atom, an alkali metal atom, an ammonium group or $$-S-\underset{\underset{S}{\|}}{C}-\underset{\underset{R^{22A}}{|}}{N}-(CH_2)_K-X^{1A},$$

wherein $R^{22A}$ is a hydrogen atom or an alkyl group;

$$A^1\text{-}(B^1)_h\text{-}A^2(Z^1)_i \quad \text{(VIIA)}$$

wherein $A^1$ and $A^2$ are each $$R^2-\overset{\overset{R^1}{|}}{\underset{\underset{(R^3)_q}{|}}{N}}-$$

or a residue of a saturated or unsaturated heterocyclic ring containing at least one nitrogen atom, and $A^1$ and $A^2$ may be the same or different; $R^1$, $R^2$ and $R^3$ are the same or different and each is a hydrogen atom or an alkyl group; q is 0 or 1; the nitrogen atom of the heterocyclic ring may be quaternized; the heterocyclic ring may optionally contain an oxygen atom and/or sulfur atom; $B^1$ is a bivalent organic group consisting of an alkylene group, an alkenylene group, an arylene group, $$-SO_2-,\ -SO-,\ -S-,\ -O-,\ -\underset{\underset{O}{\|}}{C}-\ \text{or}\ -\underset{\underset{R^4}{|}}{N}-,$$

(wherein $R^4$ is a hydrogen atom, an alkyl group or an aryl group), alone or as a combination of two or more of them; h is 0 or 1; $Z^1$ is an anion; and i is 0, 1 or 2.

7. A reducer for conducting reduction processing of black-and-white halftone images comprising (1) 1,3-propanediaminetetraacetic acid ferric chelate having an oxidation-reduction potential of −100 mV or above, (2) a complexing agent, and (3) at least one member of the compounds represented by formulae (IA) to (VIIA):

$$R^{1A}-S-M^{1A} \quad \text{(IA)}$$

wherein $M^{1A}$ represents a hydrogen atom, an alkali metal atom or an ammonium group; and $R^{1A}$ represents an alkyl group, an alkylene group, an aryl group or a residue of a heterocyclic ring;

$$R^{1A}-S-S-R^{6A} \quad \text{(IIA)}$$

wherein $R^{1A}$ is the same as in formula (IA); $R^{6A}$ has the same meaning as $R^{1A}$; and $R^{1A}$ and $R^{6A}$ are the same or different;

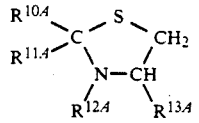

(IIIA)

wherein $R^{10}$ and $R^{11A}$ are the same or different and each is a hydrogen atom, an alkyl group, an aryl group or a residue of a heterocyclic ring; $R^{12A}$ represents a hydrogen atom or an alkyl group; and $R^{13A}$ represents a hydrogen atom, an alkyl group or a carboxyl group;

$$X^{1A}-(CH_2)_{kB}-S-C\begin{matrix}=NR^{14A}\\ -NR^{15A}R^{16A}\end{matrix} \quad \text{(IVA)}$$

wherein $R^{14A}$, $R^{15A}$ and $R^{16A}$ are the same or different and each is a hydrogen atom or an alkyl group; kB is an integer of from 1 to 5; and $X^{1A}$ represents an amino group, a sulfo group, a hydroxyl group, a carboxyl group or a hydrogen atom;

$$A^{1A}-\left(-(X^{2A})_{lA}-(R^{19A})_{mA}-\underset{\underset{(H)_{pA}}{|}}{\overset{\overset{R^{17A}}{|}}{N}}-R^{18A}\right)_{nA}[Z^{2A}]_{qA} \quad \text{(VA)}$$

wherein $R^{21A}$ is a hydrogen atom or a lower alkyl group, $R^{17A}$ and $R^{18A}$ are each an alkyl group; $R^{19A}$ is an alkyl group; $Z^{2A}$ is an anion; lA is 0 or 1; mA is 0 or 1; nA is 1, 2 or 3; pA is 0 or 1; and qA is 0, 1, 2, or 3; and $R^{17A}$ and $R^{18A}$ may be linked to each other through a carbon atom or a heteroatom to form a ring;

$$X^{1A}-(CH_2)_{Kb}-\overset{\overset{R^{22A}}{|}}{N}-\underset{\underset{S}{\|}}{C}-S-M^{2A} \quad \text{(VIA)}$$

wherein $X^{1A}$ and kB are the same as in formula (IVA); $M^{2A}$ represents a hydrogen atom, an alkali metal atom, an ammonium group or $$-S-\underset{\underset{S}{\|}}{C}-\underset{\underset{R^{22A}}{|}}{N}-(CH_2)_K-X^{1A},$$

wherein $R^{22A}$ is a hydrogen atom or an alkyl group;

$$A^1\text{-}(B^1)_h\text{-}A^2(Z^1)_i \quad \text{(VIIA)}$$

wherein $A^1$ and $A^2$ are each $$R^2-\overset{\overset{R^1}{|}}{\underset{\underset{(R^3)_q}{|}}{N}}-$$

or a residue of a saturated or unsaturated heterocyclic ring containing at least one nitrogen atom, and $A^1$ and $A^2$ may be the same or different; $R^1$, $R^2$ and $R^3$ are the same or different and each is a hydrogen atom or an alkyl group; q is 0 or or 1; the nitrogen atom of the heterocyclic ring may be quarternized; the heterocyclic ring may optionally contain an oxygen atom and/or sulfur atom; $B^1$ is a bivalent organic group consisting of an alkylene group, an alkenylene group, an arylene group, $$-SO_2-,\ -SO-,\ -S-,\ -O-,\ -\underset{\underset{O}{\|}}{C}-\ \text{or}\ -\underset{\underset{R^4}{|}}{N}-,$$

(wherein $R^4$ is a hydrogen atom, an alkyl group or an aryl group), alone or as a combination of two or more of them; h is 0 or 1; $Z^1$ is an anion; and i is 0, 1 or 2.

8. A reducer as claimed in claim 7, wherein the amount of 1,3-propanediaminetetraacetic acid ferric chelate is from 0.3 g/l to the solubility upper limit, the amount of said complexing agent is from 5 to 200 g/l, and the amount of said compound of formulae (IA) to (VIIA) is in the range of from 0.001 to 3.0 g/l.

9. A reducer as claimed in claim 7, wherein the amount of 1,3-propanediaminetetraacetic acid ferric chelate is from 5 to 70 g/l, the amount of said complexing agent is from 10 to 100 g/l, and the amount of said compound of formula (IA) to (VIIA) is the range of from 0.01 to 0.05 g/l.

10. A reducer as claimed in claim 7 which has a pH of from 2 to 8.

* * * * *